US011371174B2

(12) United States Patent
Gupta

(10) Patent No.: US 11,371,174 B2
(45) Date of Patent: Jun. 28, 2022

(54) THIMBLE GRIPPER

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 247 days.

(21) Appl. No.: 16/588,583

(22) Filed: Sep. 30, 2019

(65) Prior Publication Data

US 2020/0102679 A1 Apr. 2, 2020

Related U.S. Application Data

(60) Provisional application No. 62/739,458, filed on Oct. 1, 2018.

(51) Int. Cl.
*D05B 91/04* (2006.01)

(52) U.S. Cl.
CPC ..... *D05B 91/04* (2013.01)

(58) Field of Classification Search
CPC ..... D05B 91/04; A47J 17/10; A41D 13/087; A61F 13/105
USPC ..... 223/101; 128/880
See application file for complete search history.

(56) References Cited

U.S. PATENT DOCUMENTS 4,102,479 A 7/1978 Braley
4,127,222 A 11/1978 Adams
4,239,134 A 12/1980 Joy
4,643,341 A 2/1987 Hostetler
5,765,731 A 6/1998 Callian
5,803,322 A 9/1998 Boone et al.
6,726,068 B2 4/2004 Miller
7,296,715 B1 11/2007 Jerome
2017/0215494 A1* 8/2017 Savides ..... A47J 17/10

FOREIGN PATENT DOCUMENTS

FR 2603312 A1 * 3/1988 ..... D05B 91/04

* cited by examiner

*Primary Examiner* — Nathan E Durham
(74) *Attorney, Agent, or Firm* — Michael W. Ferrell; Robert S. Alexander; Anna L. Kinney

(57) ABSTRACT

A flexible thimble gripper is provided. The thimble gripper includes a flexible elastomeric strip terminating in an elastomeric dome at one end with an elastomeric thimble formed at the opposite end. The dome has a friction enhancing surface formed on an outer surface. The thimble has a rigid polymeric cap terminating in a region having a slip resistant surface. The cap is cutaway on a surface contiguous with the friction enhancing surface of the dome, with a friction enhancing surface formed on the adjacent region of the elastomeric band. The dome and the thimble mount upon a thumb and a finger of a user's hand. The thimble gripper is used to push a needle into material pressed by the slip resistant surface and to draw the needle from the material gripped between the friction enhancing surfaces of the dome and the elastomeric band.

10 Claims, 4 Drawing Sheets

Figure 3
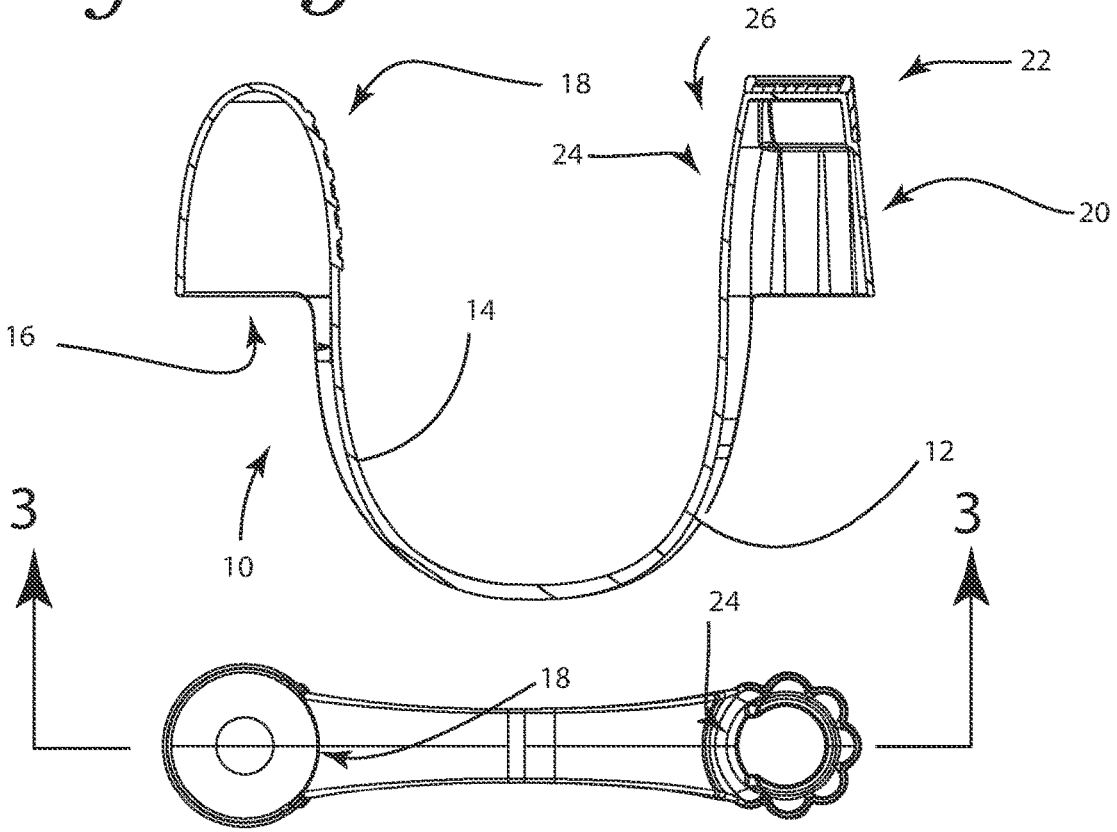
Figure 4
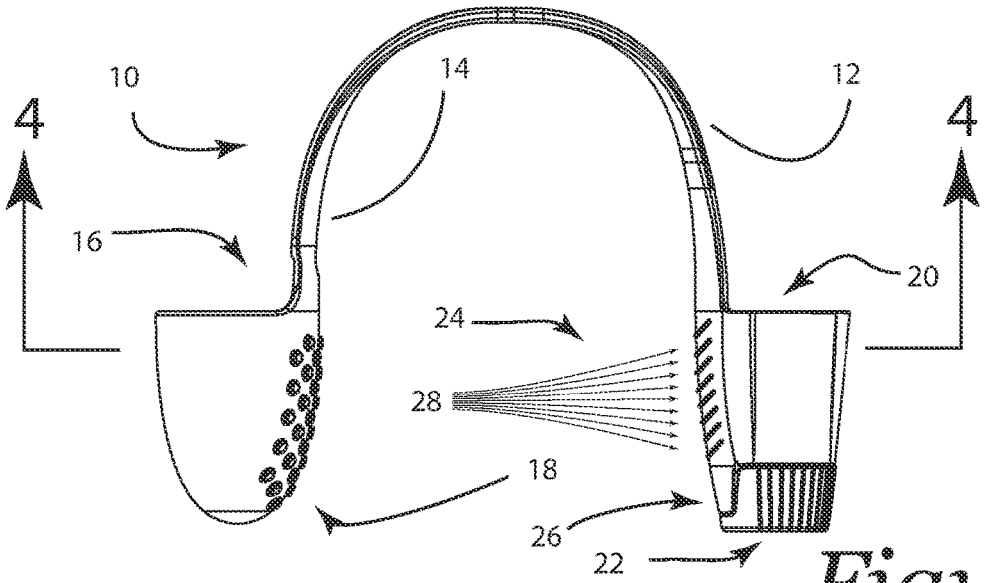
Figure 5

*Figure 6*
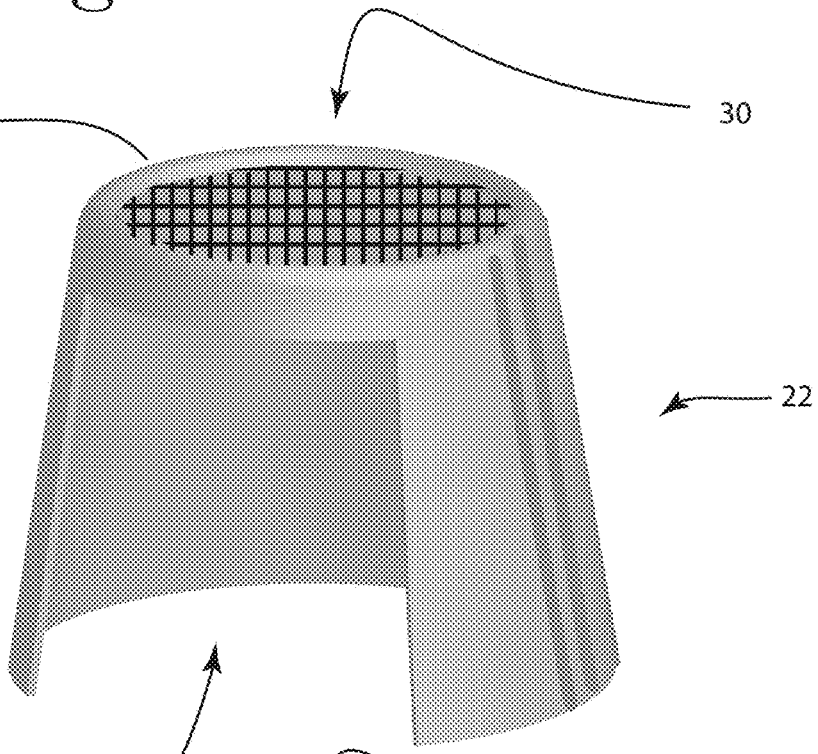
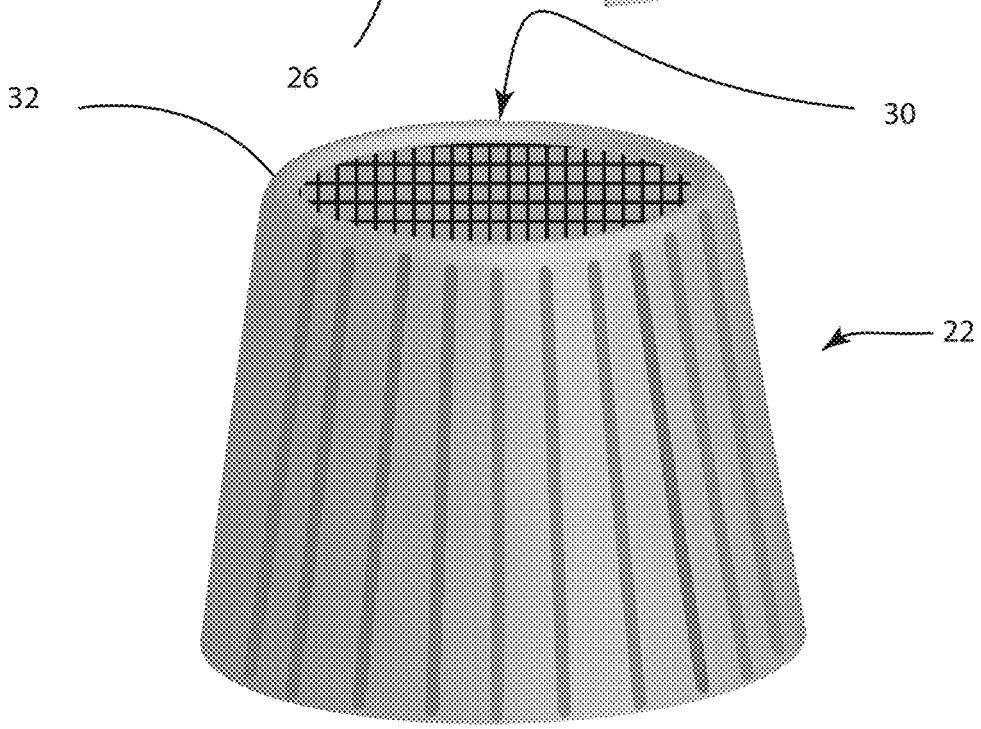
*Figure 7*

*Figure 8*
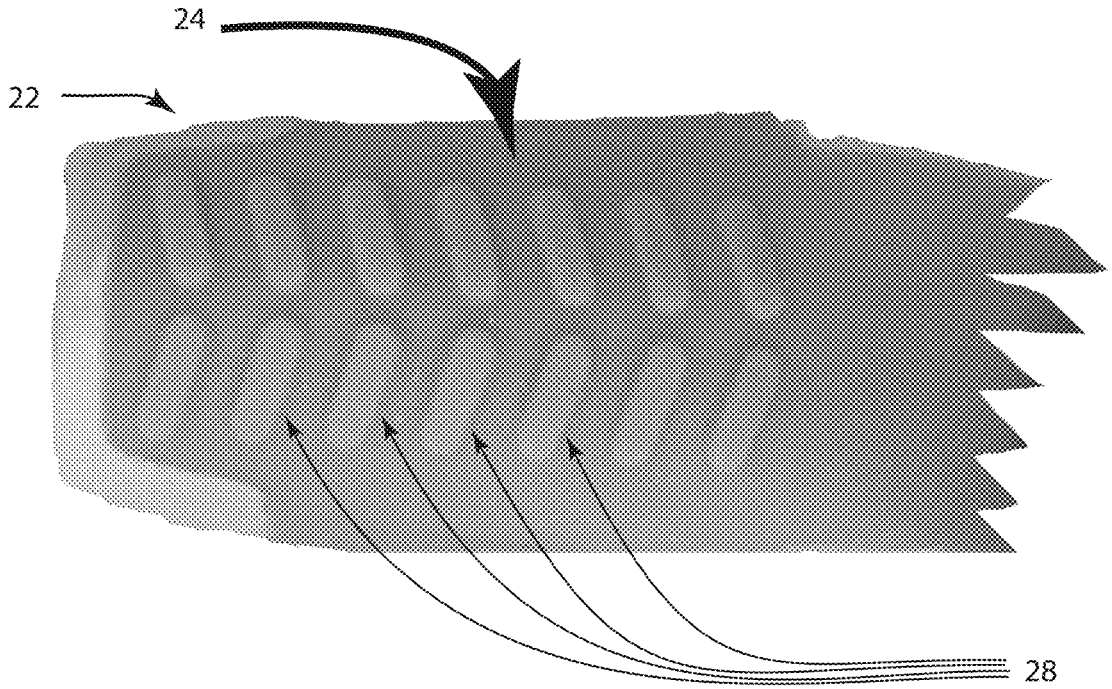
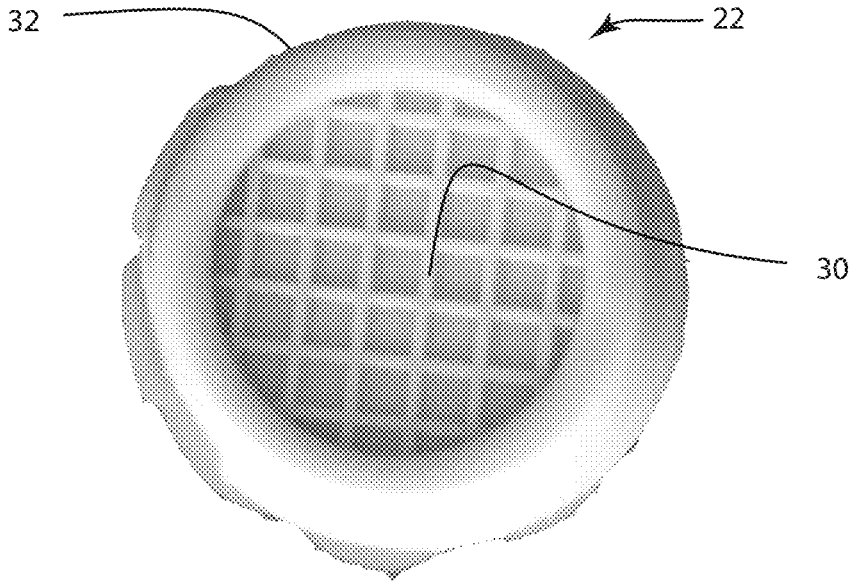
*Figure 9*

THIMBLE GRIPPER

CLAIM FOR PRIORITY

This Non-Provisional patent application is based on U.S. Provisional Patent Application Ser. No. 62/739,458, filed on Oct. 1, 2018, the priority of which is claimed, and the disclosure of which is incorporated by reference.

BACKGROUND OF THE INVENTION

Save the modern sewing machine, seamstresses today often struggle by with equipment that would be recognizable by their great grandmothers. Vintage brass, silver and porcelain thimbles including some said to date to the $19^{th}$ Century are offered for sale on-line, with precious little separating functionality of these "vintage" thimbles from modern thimbles typically formed from stainless steel or hard polymers. Yet there is much to be desired to improve the functionality as the typical thimble is formed from hard rigid material which makes thimble bearing digits usable primarily for pushing a needle into material but greatly impairing use of that digit for gripping, as the lateral surfaces of thimbles formed from hard material typically exhibit a rather low coefficient of friction. This application relates to a low cost thimble gripper combination which enables the user to both push a needle into material and then, on the other side of the material, grasp the needle between the thumb and forefinger and pull it through without removing the thimble from the forefinger.

Braley, U.S. Pat. No. 4,102,479 discloses a thimble having a resilient frustoconical resilient liner cooperating with a concentrically disposed resilient pad defining a circumferentially extending space adapted for use by a person having long fingernails, with the end of the finger in abutting contact with the resilient pad. The liner is formed from a soft coarse resilient material, allowing air to the enclosed finger portion while keeping the enclosed finger portion cool and dry. Optionally, the longitudinal length of the thimble may be increased by a resilient band removably gripping the bead on the end portion of the thimble opposite the end portion that is closed by the end piece.

Adams, U.S. Pat. No. 4,127,222, discloses a sewing thimble having an elongated, tubular body consisting of a pliable material, such as rubber, wherein a plurality of vent holes are disposed about the annular body portion, the inner bore thereof being designed to conform to the average finger, including those having extended fingernails. The forward head portion of the thimble is enlarged with a thickened area of a hard rubber or plastic to allow for forceful engagement with a needle to be threaded. Alternative arrangements include a protective shield embedded within the head portion and a threading-and-cutting device mounted to the thimble at the tip of the enlarged head thereof.

Joy, U.S. Pat. No. 4,239,134, discloses a flexible thimble for sewing which allows the thimble to conform to the finger for fit and comfort; providing a supple surface to allow the user to actually feel the needle; and provides a protective means located near the closed end of the thimble for covering part of the normal fingertip and fingerprint area, to protect the finger from the penetration of sharp objects.

Hostetler, U.S. Pat. No. 4,643,341, discloses a sewing thimble having an inner barrel, a blade segment and an outer shell. The molded inner shell is semi-rigid and has a projecting lug for positioning the cutting edge of the blade segment. The outer shell is resilient or slightly deformable and is molded around and encases the inner barrel. The outer shell has a laterally projecting and thickened bulb area which covers the inner barrel lug beneath the cutting edge of the blade segment. A flap cut is formed in the bulb area so that a user may grip and pull a needle and thread by thumb pressure applied against the bulb area.

Callian, U.S. Pat. No. 5,765,731, discloses a thimble for use in quilting. sewing or the like to manipulate a needle including a flexible member and a shield member. The flexible member has four notches in spaced apart relation forming four tab portions positioned therebetween. The notches enable the tab portions to be bent about a finger of a person for conforming and fitting the thimble to the finger. One of the tab portions may be elongated to provide an elongated flap for fitting the thimble on a finger with a long fingernail. The flexible member is attached to or integrally formed with an adhesive material for securing the thimble to the finger of a person to prevent slippage of the thimble. The thimble further includes a shield member attached to the adhesive material of the flexible member for protecting the finger from contact with the needle. The shield member includes a dimple for seating the needle during use of the thimble and a curved surface for conforming to the finger of a person.

Boone et al., U.S. Pat. No. 5,803,322 discloses a stitch laying tool having a cylindrical thimble body having a center axis and a cylindrical side wall with opposite open ends to receive the tip of a stitcher's finger. An elongated stiff wire is secured to the side wall and extends substantially parallel to the center axis and has an outer end extending beyond one end of the cylindrical side wall. The outer end of the stiff wire has a short straight wire segment which forms an angle with respect to the stiff wire.

Miller, U.S. Pat. No. 6,726,068 B2, discloses a finger protective device constructed from elastomeric materials having a working surface covering the fleshy portion of a finger having sufficient strength and hardness to avoid penetration by a needle, yet being elastomeric to accommodate large variations in shape. The working surface may be interrupted by ribs or protrusions to prevent needle slippage. A compliant member surrounds the remainder of the finger and is softer in order to comply with the majority of finger shape variations. The thimble thus formed is designed to conform to the shape of a finger and remain adhered by frictional means to provide comfortable protection.

Jerome, U.S. Pat. No. 7,296,715 B1, discloses a thimble device for protecting fingers and thumb from a needle during a sewing operation wherein the thimble device comprises a top needle bearing surface having a dimple formed therein and two side surfaces with each side surface having an angled portion and a curved portion. The curved portions are sized and shaped for receiving a portion of the fingers when the thimble device is seated between the fingers. The thimble device further includes an angled front surface, an angled rear surface, and a curved bottom surface sized and shaped for receiving a portion of the thumb.

SUMMARY OF THE INVENTION

A flexible thimble gripper comprises a flexible elastomeric strip terminating in an elastomeric dome formed thereupon at one end thereof, projecting from said strip in one direction, said dome having a first friction enhancing surface formed on an outer surface thereof, said strip having an elastomeric thimble formed at the opposite end thereof, said thimble projecting therefrom in said one direction and having a rigid polymeric cap joined thereto, said cap terminating in a region having an upper slip resistant surface formed therein, said cap being cutaway on a surface contiguous with a second friction enhancing surface being formed on said elastomeric band in the region adjacent said cutaway, said dome and said thimble being adapted to be mounted upon the thumb and a finger of a user's hand so that a needle may be pushed into material by pressure from the slip resistant surface of the cap and drawn from said material when gripped between the first friction enhancing surface of said dome and the second friction enhancing surface formed on said elastomeric band in the region adjacent said cutaway in said cap. Preferably, the thimble gripper of the present invention is formed by dual shot injection molding.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

FIG. 3 is a longitudinal sectional view through the thimble gripper of FIG. 4 of the present invention, inclusive of the dome, thimble, and cap as shown in FIG. 5.

FIG. 4 is a sectional view through the dome and thimble of the thimble gripper of FIG. 5 of the present invention.

FIG. 5 is a side elevational view of the thimble gripper of the present invention.

FIG. 6 is a perspective view of the cap of the thimble portion of the thimble gripper of the present invention illustrating the cutaway and the slip resistant surface.

FIG. 7 is a perspective view of the cap of the thimble portion of the thimble gripper of the present invention illustrating the slip resistant surface and the surface opposed to the cutaway.

FIG. 8 illustrates a friction enhancing surface formed in the elastomeric band in the portion within the cutaway in the cap.

FIG. 9 illustrates the slip resistant surface and the peripheral ridge on the surface of the cap of the thimble portion of the thimble gripper of the present invention.

DETAILED DESCRIPTION OF THE PREFERRED EMBODIMENT

The invention is described in detail below with reference to an embodiment. Such discussion is for purposes of illustration only. Modifications within the spirit and scope of the present invention, set forth in the appended claims, will be readily apparent to one of skill in the art. Terminology used herein is given its ordinary meaning consistent with the exemplary definitions set forth immediately below.

The transitional phrase "consisting essentially of" limits the scope of a claim to the specified materials or steps "and those that do not materially affect the basic and novel characteristic(s)" of the claimed invention. With respect to product claims, "consisting essentially of" and like terminology refers to the recited components and excludes other ingredients which would substantially change the basic and novel characteristics of the composition or article. Unless otherwise indicated or readily apparent, a composition or article consists essentially of the recited components when the composition or article includes 90% or more by weight of the recited components. That is, the terminology excludes more than 10% unrecited components.

Figure 1:
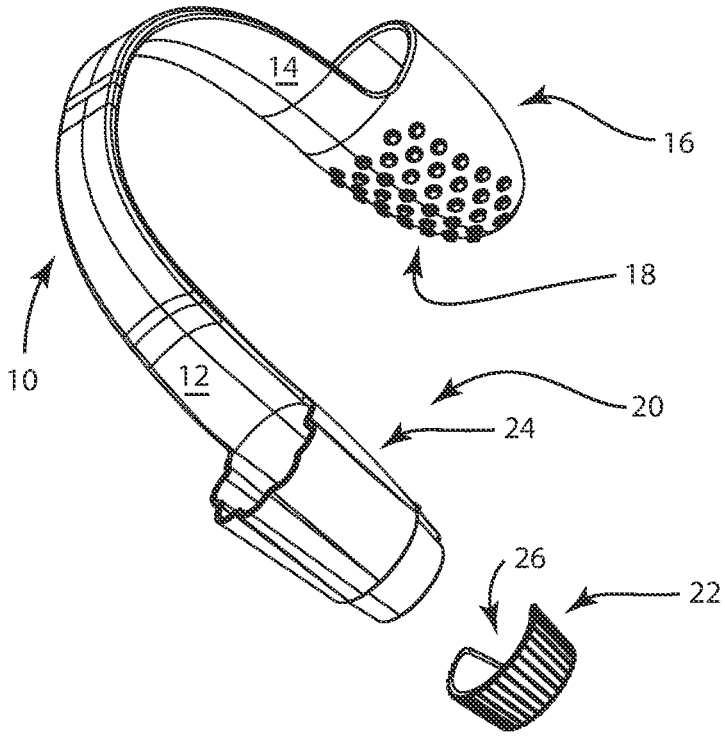
FIG. 1 is an exploded perspective view of the thimble gripper of the present invention arrayed in a configuration suitable for mounting on the thumb and a finger of a user's hand.
Figure 2:
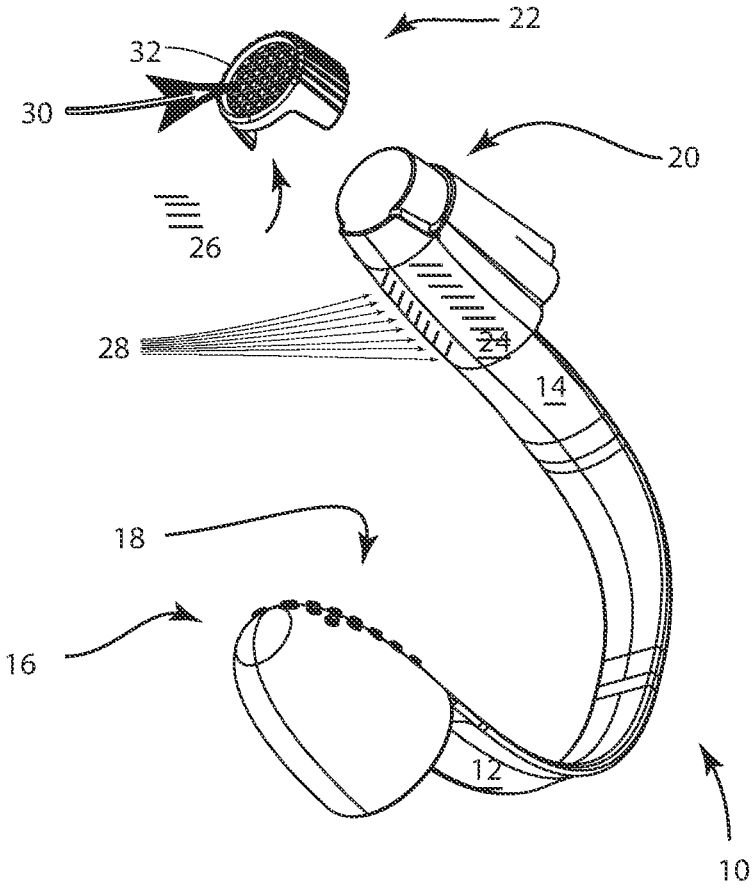
FIG. 2 is another exploded perspective view of the thimble gripper of the present invention arrayed in a configuration suitable for mounting on the thumb and a finger of a user's hand.

In FIGS. 1-5, elastomeric band 10 has upper surface 12 and lower surface 14 defined thereupon with dome 16 formed at one end thereof with dimpled friction enhancing surface 18 defined thereupon contiguous with lower surface 14 of the elastomeric band 10. Dome 16 projects from upper surface 12 of elastomeric band 10. Elastomeric thimble portion 20 projecting from upper surface 12 of elastomeric band 10 at opposed end from dome 16 is adapted to receive the tip of a finger of a user. Cap 22, formed from a hard polymer, is shown removed from thimble portion 20 for clarity but is preferably permanently affixed to thimble portion 20, ideally by interlocking molding in a dual shot injection molding process. Friction enhancing surface 24 is defined in the area bordered by cutaway 26. One suitable pattern for enhancing friction is shown in chevrons. In FIG. 9, slip resistant surface 30 circumscribed by ridge 32 is formed atop cap 22 making it possible for the user to push a needle through material using the tip of the user's finger upon which thimble portion 20 is placed. Once the needle has emerged from the opposite side of the material, the user can pull the needle through by grasping it between friction enhancing surfaces 24 and 18. Preferably all of thimble gripper except cap 22 will be formed from a soft silicone polymer while cap 22 is formed from a rigid polymer allowing the looped end of a needle to be forced through material while engaging slip resistant surface 30 without penetrating cap 22.

In FIGS. 6 and 7, details of cap 22 are shown particularly slip resistant surface 30 circumscribed by ridge 32 formed atop cap 22.

In FIGS. 8 and 9, a detail of the friction enhancing surface 24 protruding into cutaway 26 showing chevrons 28 on friction enhancing surface 24 is shown along with slip resistant surface 30 circumscribed by ridge 32 atop cap 22. The thimble gripper of the present invention has the advantage that the user can both push the needle into material and pull it out without removing the thimble gripper from the hand. Further, a hand having thimble gripper on the thumb and a finger remains usable for other purposes as well without removing the thimble gripper.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. A flexible thimble gripper comprising a flexible elastomeric band terminating in an elastomeric dome formed at one end thereof, said dome projecting from said band in one direction, said dome having a first friction enhancing surface formed on an outer surface thereof in a first pattern, said gripper having an elastomeric thimble portion formed at an end of the elastomeric band opposite the dome end thereof, said thimble portion projecting therefrom in said one direction and having a rigid polymeric cap joined thereto, said cap terminating in a region having an upper slip resistant surface formed thereon, said cap being disposed on said elastomeric thimble portion of said gripper and being cutaway over a a second friction enhancing surface formed on said thimble portion of said gripper in a second pattern in a region framed by said cutaway, said dome and said thimble portion of said gripper being positioned, configured and dimensioned to be mounted upon a thumb and a finger of a user's hand so that a needle may be pushed into material by pressure from the slip resistant surface of the cap and drawn from said material when gripped between the first friction enhancing surface of said dome and the second friction enhancing surface formed on said thimble portion of said gripper in the region framed by said cutaway in said cap and wherein said first and second patterns of the friction enhancing surfaces are different patterns.

2. The flexible thimble gripper of claim 1, wherein the thimble gripper of the present invention is formed by dual shot injection molding interlocking the cap with the elastomeric thimble portion.

3. The flexible thimble gripper of claim 1, wherein said first and second patterns of the friction enhancing surfaces are selected from: a pattern of dimples and a pattern of raised elongate elements.

4. The flexible thimble gripper of claim 1, wherein the elastomeric thimble portion of said gripper has a frustoconical shape with a scalloped sidewall.

5. A combination needle gripper and thimble, comprising an elastomeric dome formed at an end of an elastomeric band with an elastomeric thimble portion formed at an opposing end of the elastomeric band, wherein the elastomeric band is flexible and adapted to conform to a thenar space of a user's hand; the dome and elastomeric thimble portion are each provided with a friction-enhancing surface, said friction-enhancing surfaces positioned to face each other in use; and each of the dome and the elastomeric thimble portion are adapted to conform to a user's finger or thumb, wherein the elastomeric thimble portion has a rigid polymeric cap adjacent the friction-enhancing surface of the elastomeric thimble portion, wherein said dome, elastomeric thimble portion and cap are positioned, configured and dimensioned so that when the dome and elastomeric thimble portion are mounted upon a thumb and a finger of a user's hand, a needle may be pushed into material by pressure from a slip resistant surface of the cap and drawn from said material when gripped between the friction enhancing surfaces of said dome and elastomeric thimble portion of said gripper in a region adjacent said cap and wherein the friction enhancing surfaces of said dome and elastomeric thimble portion of said gripper and thimble each have friction enhancing elements arranged in different patterns thereon.

6. The combination needle gripper and thimble of claim 5, wherein the rigid polymeric cap is formed with a cutaway adjacent the friction-enhancing surface of the elastomeric thimble portion of said gripper and thimble, said rigid polymeric cap further comprising the slip resistant surface circumscribed by a ridge atop the cap.

7. The combination needle gripper and thimble of claim 5, wherein the friction enhancing surface of said dome is a dimpled surface and the friction enhancing surface of the elastomeric thimble portion of said gripper and thimble comprises a plurality of raised elongate elements.

8. The combination needle gripper and thimble of claim 7, wherein the friction enhancing surface the elastomeric thimble portion of said gripper and thimble comprises a chevron pattern of raised elongate elements.

9. The combination needle gripper and thimble of claim 5, wherein the elastomeric thimble portion of said gripper and thimble has a frustoconical shape with a scalloped sidewall.

10. The flexible thimble gripper of claim 9, wherein said first and second patterns of the friction enhancing surfaces are selected from: a pattern of dimples and a pattern of raised elongate elements arranged in a chevron pattern.

* * * * *